United States Patent [19]

Schlain et al.

[11] 4,053,377

[45] Oct. 11, 1977

[54] ELECTRODEPOSITION OF COPPER

[75] Inventors: David Schlain, Greenbelt; Frank X. McCawley, Cheverly; Gerald R. Smith, Columbia, all of Md.

[73] Assignee: The United States of America as represented by the Secretary of the Interior, Washington, D.C.

[21] Appl. No.: 657,894

[22] Filed: Feb. 13, 1976

[51] Int. Cl.[2] ..... C25C 1/12; C25C 7/00; C25D 3/38; C25D 17/00

[52] U.S. Cl. ..... 204/106; 204/52 R; 204/108; 204/275

[58] Field of Search ..... 204/106, 202, 206–209, 204/275, 107, 108, 276–278, 52 R

[56] References Cited

U.S. PATENT DOCUMENTS

| | | | |
|---|---|---|---|
| 2,445,675 | 7/1948 | Lang | 204/209 |
| 2,535,966 | 12/1950 | Teplitz | 204/206 |
| 2,592,810 | 4/1952 | Kushner | 204/25 |
| 3,003,939 | 10/1961 | Rouy et al. | 204/164 |
| 3,506,546 | 4/1970 | Semienko et al. | 204/28 |
| 3,535,222 | 10/1970 | Cooke et al. | 204/207 |

OTHER PUBLICATIONS

Wesley et al., Proceeding American Electroplaters Society, vol. 36, pp. 80, 81, 82, 91 (1949).

*Primary Examiner*—F.C. Edmundson
*Attorney, Agent, or Firm*—William S. Brown; Donald A. Gardiner

[57] ABSTRACT

The invention consists of a method for electrowinning or electrorefining of metals, particularly copper, comprising electrodepositing the metal from an electrolyte solution under conditions comprising high cathode and anode current densities and high velocity flow of electrolyte past the electrode surfaces. Current densities of about 60 to 400 amp/sq ft are employed, with electrolyte flow rates of at least 75 ft/min, preferably about 150 to 400 ft/min.

1 Claim, 1 Drawing Figure

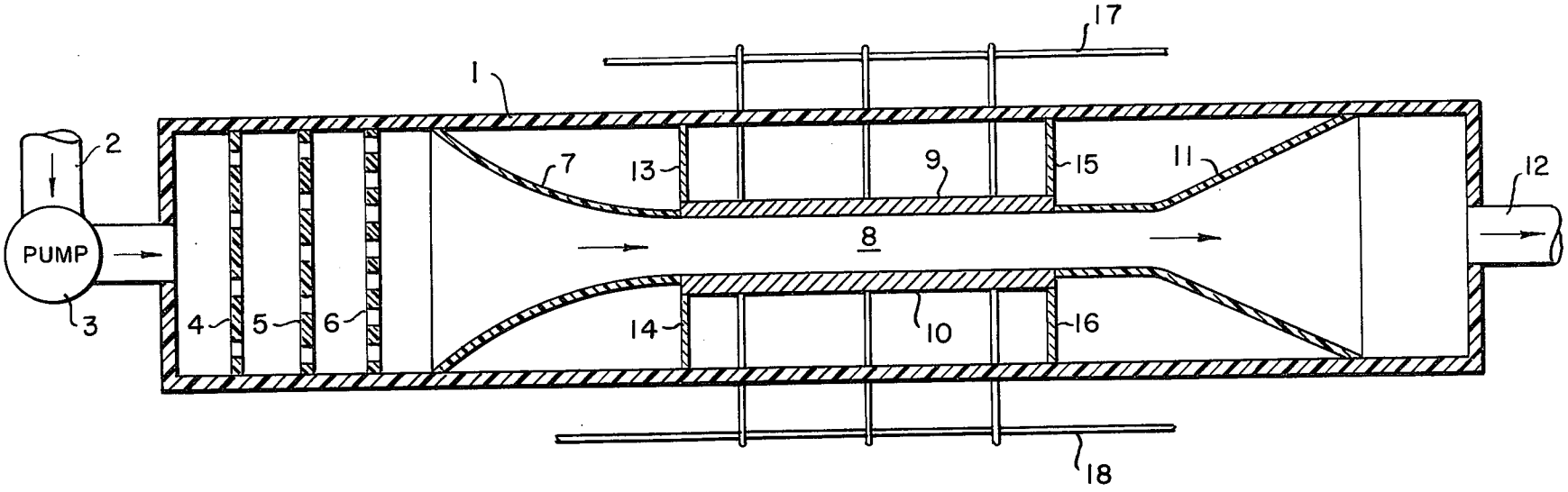
PUMP
1
2
3
4
5
6
7
8
9
10
11
12
13
14
15
16
17
18

ELECTRODEPOSITION OF COPPER

Commercial electrorefining and electrowinning of metals is conventionally done at low current densities, typically about 15 to 30 amp/sq ft. The use of higher current densities is potentially more efficient and economical; however, previous attempts at the use of higher current densities have commonly resulted in concentration polarization and the formation of rough, powdery, poorly-consolidated deposits. In addition, occlusion of slimes and codeposition of impurities have generally resulted in impure products. Various procedural modifications have been employed in efforts to overcome these deficiencies of the prior art methods, but generally with limited success. These include utilization of moderately rapid movement of electrolyte relative to the electrodes, achieved by moving either the electrodes or the electrolyte. Such procedures are exemplified by the methods disclosed in U.S. Pat. No. 3,832,296 and in an article entitled "Electrolytic Copper Refining at High Current Densities" by S. J. Wallden et al in Journal of Metals, August 1959, pages 528–534.

It has now been found, according to the method of the invention, that the deficiencies of the prior art can be largely overcome by the use of very rapid, and uniform, movement of electrolyte past the electrodes, in combination with high current density. Applicants have found that a uniform rate of movement of electrolyte past the electrodes of at least 75 ft/min, and preferably about 150 to 400 ft/min, results in greatly decreased polarization, occulsion and codeposition of impurities as compared to the prior art, even when current densities as high as 400 amp/sq ft are employed.

Applicants have also found that the desired rapid movement of electrolyte relative to the electrodes is most effectively achieved by use of an electrolytic cell in which the electrolyte is caused to flow through a narrow channel formed by a single cathode-anode pair. This enables simple and accurate control of electrolyte flow, whereby the desired rapid and uniform movement of electrolyte may be achieved. Applicants have found that the use of a single cathode-anode pair of suitable configuration, an example of which is more fully described below, is important in achieving the desired uniform, rapid movement of electrolyte past the electrodes.

The critical nature of the combination of process limitations of the invention, i.e., rapid, uniform movement of electrolyte and high current density, is illustrated in the following examples. The apparatus employed in the examples was a laboratory scale electrolytic cell which will be described with reference to the figure, which is a cross-sectional top view of the cell. Cell container 1 consists of an oblong vessel about 8 feet in length and 4 inches in depth and constructed of 1 inch thick Plexiglas (polymethyl methacrylate). Electrolyte is fed to the cell at the required flow rate via line 2 and centrifugal pump 3. It enters the cell and passes through sequential turbulence baffles 4, 5 and 6 before being channeled into the gap between the cathode and anode. The baffles consist of plates provided with increasing numbers of orifices, as illustrated, which serve to minimize turbulence that may have been produced by operation of the pump and by passage of the electrolyte into the larger chamber.

The electrolyte then flows through venturi 7 which provides a gradually narrowing path of flow for the electrolyte into the gap between the electrodes, thereby serving to further prevent or eliminate turbulence in flow of the electrolyte. The electrolyte then flows through channel 8 formed by cathode 9 and anode 10 and exits the channel via exit chamber 11. The electrolyte then leaves the cell via line 12.

The electrodes are centrally and removably supported within the cell by means of support members 13, 14, 15 and 16, and are supplied with the required electrical potential via bus bars 17 and 18 in order to provide the desired current density.

EXAMPLES 1–7

In these examples, the above-described electrolytic cell was employed for electrorefining of copper, a process involving dissolution of an impure copper anode and electrodeposition of pure copper on the cathode. The electrodes were 11 inches in length and 2 inches deep, with the electrode spacing, i.e., the width of the channel between the electrodes, being about ½ inch. The cathode was initially about ¼ inch thick and consisted of titanium, the anode initially being about 1½ inches thick and consisting of blister copper having the following analysis:

| | |
|---|---|
| Copper | 99.63% |
| Oxygen | .127 |
| Sulfur | .0021 |
| Tin | .00035 |
| Lead | .0047 |
| Bismuth | .00160 |
| Nickel | .050 |
| Antimony | .0058 |
| Iron | .00170 |
| Tellurium | .0170 |
| Arsenic | .0290 |
| Selenium | .07 |
| Gold | 1.4387 Troy oz./short ton |
| Silver | 16.381 Troy oz./short ton |

The electrolyte, which was typical of those used in commercial-copper refineries, consisted essentially of an aqueous solution of copper sulfate and sulfuric acid and contained specifically the following in grams per liter: Cu, 47; $H_2SO_4$, 225; Ni 10.4; Fe 1.4; As, 1.2; Ag, 0.001; Bi, 0.032; Ca, 0.58; Cl, 0.01; Sb, 0.43; Sn, 0.003 and Pb, 0.008.

Operating temperature of the cell was about 55° C. Values of current densities, electrolyte flow rates, deposition times and the thickness of the resulting copper deposits are given in Table 1.

TABLE 1

| Example | Current density, amp/sq ft | Electrolyte flow, ft/min | Thickness of copper depo-, sil, mils | Deposition time, hrs |
|---|---|---|---|---|
| 1 | 300 | 400 | 272 | 16 |
| 2 | 200 | 300 | 352 | 32 |
| 3 | 200 | 300 | 203 | 18½ |
| 4 | 200 | 300 | 297 | 27 |
| 5 | 90 | 285 | 194 | 38 |
| 6 | 60 | 300 | 261 | 77 |
| 7 | 90 | 300 | 502 | 118 |

It will be seen that thick deposits were obtained, even at high current densities. In addition, the deposits were smooth, well consolidated and of high purity. Furthermore, the deposits showed no surface deterioration even after long deposition times (examples 6 and 7).

Although the invention has been illustrated by experiments conducted in the above-described electrolytic cell, it is not limited to the specific cell or conditions. For commercial cells the electrodes would usually be substantially larger, probably with some variation in electrode spacing as well as electrode materials, and could include multiple channels arranged in parallel. Also, the specific structure of the cell is not critical, provided the required current density and uniform high velocity flow of electrolyte is provided. Optimum operating temperatures may also vary somewhat, but will probably generally be not far from the 55° C employed in the above examples. In addition, application of the invention is not limited to electrorefining, as illustrated in the examples, but may also be employed for electrowinning of copper from ores, concentrates or dilute solutions. Furthermore, the process of the invention is not limited to copper, but could also be used for electrorefining or electrowinning of other metals.

What is claimed is:

1. A method for electrorefining or electrowinning of copper comprising electrodepositing the copper from an electrolyte consisting essentially of an aqueous solution of copper sulfate and sulfuric acid under conditions comprising cathode and anode current densities of about 60 to 400 amp/sq. ft. and a substantially non-turbulent flow of electrolyte past the electrode surfaces at a rate of about 150 to 400 ft/min, said non-turbulent flow being achieved by means of a venturi section and a single cathode-anode pair.

* * * * *